US007331821B2

(12) United States Patent
Feldman

(10) Patent No.: US 7,331,821 B2
(45) Date of Patent: Feb. 19, 2008

(54) ELECTRICAL CONNECTOR

(75) Inventor: Steve Feldman, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/346,066

(22) Filed: Feb. 2, 2006

(65) Prior Publication Data

US 2006/0128216 A1 Jun. 15, 2006

Related U.S. Application Data

(63) Continuation of application No. 10/219,423, filed on Aug. 15, 2002, now Pat. No. 7,021,963.

(51) Int. Cl.
*H01R 9/05* (2006.01)

(52) U.S. Cl. ..... 439/578

(58) Field of Classification Search ..... 439/578, 439/851, 948, 843, 852, 856, 842
See application file for complete search history.

(56) References Cited

U.S. PATENT DOCUMENTS

| | | | | |
|---|---|---|---|---|
| 2,563,761 | A | | 8/1951 | Uline |
| 3,404,367 | A | | 10/1968 | Henschen |
| 3,786,558 | A | | 1/1974 | McCarthy |
| 4,021,010 | A | * | 5/1977 | Bliss ..... 244/182 |
| 4,272,149 | A | | 6/1981 | Gallusser et al. |
| 4,275,948 | A | | 6/1981 | Gallusser et al. |
| 4,359,258 | A | | 11/1982 | Palecek et al. |
| 4,412,717 | A | | 11/1983 | Monroe |
| 4,431,256 | A | | 2/1984 | Piscitelli et al. |
| 4,447,108 | A | | 5/1984 | Ghigliotti et al. |
| 4,550,972 | A | | 11/1985 | Romak |
| 4,664,467 | A | | 5/1987 | Tengler et al. |
| 4,690,481 | A | * | 9/1987 | Randolph ..... 439/585 |
| 4,703,301 | A | | 10/1987 | Hollweck et al. |
| 4,840,588 | A | | 6/1989 | Lancella |
| 4,934,964 | A | | 6/1990 | Mazelle |
| 5,055,068 | A | | 10/1991 | Machura et al. |
| 5,060,373 | A | | 10/1991 | Machura et al. |
| 5,190,472 | A | | 3/1993 | Voltz et al. |
| 5,199,910 | A | | 4/1993 | Kahle et al. |

(Continued)

FOREIGN PATENT DOCUMENTS

| | | | |
|---|---|---|---|
| DE | 25 23 361 | A | 12/1976 |

(Continued)

*Primary Examiner*—Phuong Dinh
(74) *Attorney, Agent, or Firm*—Melanie G. Gover; Johannes P. M. Kusters

(57) ABSTRACT

Disclosed is an electrical connector for use with a coaxial cable. In one aspect, the electrical connector is for use with a coaxial cable having a central signal conductor and an insulative core tube surrounding the central signal conductor such that an air gap is provided between the central conductor and the core tube, the electrical connector comprising a substantially tubular hollow body having a first end and a second end, and a solder cup disposed adjacent to said second end of said hollow body, said solder cup having a flared portion distal to said second end of said hollow body, wherein the flared portion is configured to span the air gap between the central conductor and the core tube.

8 Claims, 3 Drawing Sheets

U.S. PATENT DOCUMENTS

| | | | |
|---|---|---|---|
| 5,542,861 | A | 8/1996 | Anhalt et al. |
| 5,611,707 | A | 3/1997 | Meynier |
| 5,760,316 | A | 6/1998 | Niolon, Jr. |
| 5,762,526 | A | 6/1998 | Kuramoto et al. |
| 5,897,404 | A | 4/1999 | Goodman et al. |
| 5,957,724 | A | 9/1999 | Lester |
| 6,045,402 | A | 4/2000 | Embo et al. |

FOREIGN PATENT DOCUMENTS

| | | | |
|---|---|---|---|
| DE | 25 24 346 | A | 12/1976 |
| EP | 0 663 706 | B1 | 1/1995 |
| FR | 0654847 | * | 10/1994 |
| JP | HEI 10-172663 | | 6/1998 |
| JP | 1073146 | * | 1/2001 |
| WO | WO 99/54903 | | 10/1999 |

* cited by examiner

ELECTRICAL CONNECTOR

RELATED APPLICATION

This application is a continuation of U.S. patent application Ser. No. 10/219,423, filed Aug. 15, 2002, now U.S. Pat. No. 7,021,963, issued Apr. 4, 2006.

TECHNICAL FIELD

The present disclosure pertains to an electrical connector for use with a coaxial cable.

BACKGROUND

An electrical contact provides a junction for two electrical conductors through which a current passes. When used with electrical conductors, such as a coaxial cable, the combination of the electrical contact and the cable, along with other components, can be referred to as an electrical connector. Preferably, the electrical connector provides mechanical and electrical contact between two elements of an electronic system without unacceptable signal distortion or power loss. Several electrical contacts and their respective electrical connector systems are available.

U.S. Pat. No. 5,190,472 (Voltz et al.) discloses a miniaturized high-density interconnect system for use in termination of coaxial signal cables to electrical signal transmission systems. In some embodiments, a signal contact comprising a three-beam cylindrical body is used. As shown in FIGS. 3 and 7 of the patent, the beams on the signal contact have a rectangular cross-section.

U.S. Pat. No. 4,359,258 (Palecek et al.) discloses a circuit board mounted electrical connector having a socket and an integral solder tail. The socket has a pair of integral beam portions extending from a cylindrical base portion. As a male contact is inserted between the pair of integral beam portions, they deflect outwardly and are resiliently biased against the contact to retain the contact and to establish an electrical contact connection between the contact and the beam portions. Also, U.S. Pat. No. 5,199,910 (Kahle et al.), in FIGS. 4, 5 and 6, among other places, discloses a female contact that includes a tri-beam end for electrical connection with a male contact. And, U.S. Pat. No. 6,045,402 (Embo et al.), in FIGS. 2, 4 and 5, among other places, discloses socket contacts having dual beams. These references show that the beams have a first end that is free, the end where the contact is first inserted, and a second end that is supported, usually by a shaft or a cylindrical portion.

Yet another reference is U.S. Pat. No. 3,404,367 (Henschen) disclosing a contact socket having two spaced-apart substantially square end sections that are connected to each other by semi-elliptic springs. FIG. 2 shows that each spring is an integral part of and forms the sides of the end sections. The springs are said to be capable of substantial deflection upon insertion of a contact pin so that a wide range of pin sizes can be accommodated by a given socket size. This patent shows that each contact socket has four springs.

Although the foregoing technology may be useful, there exists a need for other electrical contacts and electrical connectors that are easy to use, that can better minimize electrical discontinuities, and that can be manufactured in a streamlined, economical process.

SUMMARY

The present invention provides a new electrical contact designed to minimize electrical discontinuities that can arise when connecting two electrical conductors. As a result, better electrical connection can be achieved leading to improved bandwidth performance for the electrical device.

In brief summary, in one aspect, the invention relates to an electrical contact having a longitudinal axis and comprising a substantially tubular, hollow body having a first end and a second end. The first end has a bounded aperture. The body has at least two elongated slots and at least two contact members, both disposed along the longitudinal axis. The phrase "disposed along the longitudinal axis" means that the elongated slot or the contact members lie generally parallel to the longitudinal axis. One skilled in the art will recognize that either the elongated slot or the contact member can lay at an angle, i.e., not parallel to, the longitudinal axis. Each contact member has a compound curve. A solder cup is disposed adjacent the second end of the body. The solder cup has a flared portion distal to the second end of the body. In another aspect of the invention, the electrical contact is stamped and formed from metal substrates and at least one of the contact members has a compound curve.

In yet another aspect, the invention relates to a terminated electrical connector comprising an electrical contact mounted on a coaxial cable, at least a portion of both residing in a conductive shell. The electrical contact has a longitudinal axis and comprises a substantially tubular, hollow body having a first end and a second end. The first end has a bounded aperture. The body has at least two elongated slots disposed parallel to the longitudinal axis thus forming contact members. Each contact member has a compound curve. A solder cup is disposed adjacent to the second end of the body. The solder cup has a flared portion distal to the second end of the body. The coaxial cable comprises a central signal conductor, optionally metal braid wrapped around the central signal conductor, a core tube surrounding the central signal conductor and the metal braid (if used), at least one layer of metal wire shielding the core tube, and a jacket surrounding the metal wire. When attached, the flared portions on the electrical connector abut the core tube of the coaxial cable. And, the central signal conductor in the coaxial cable is disposed in at least a portion of the solder cup of the electrical connector.

An advantage of the present invention is the design of the contact members. Because each contact member has a compound curve, as further described herein, it is able to make good mechanical and electrical contact with the signal pin. Thus, the inventive electrical contact minimizes electrical discontinuities that are inherent in systems where two electrical conductors are connected.

Another advantage of the present invention is that the electrical contact has contact members that act as springs, where the springs exhibit a variable rate. This variable spring rate nature of the contact members enables the connector to accommodate a wider range of signal pin diameters.

BRIEF DESCRIPTION OF THE DRAWINGS

The invention will be further described with reference to the drawings wherein in accordance with the present invention.

These figures are idealized, not drawn to scale, and are intended merely to be illustrative and non-limiting. In the figures, like reference numbers represent like parts.

DETAILED DESCRIPTION

Figure 1:
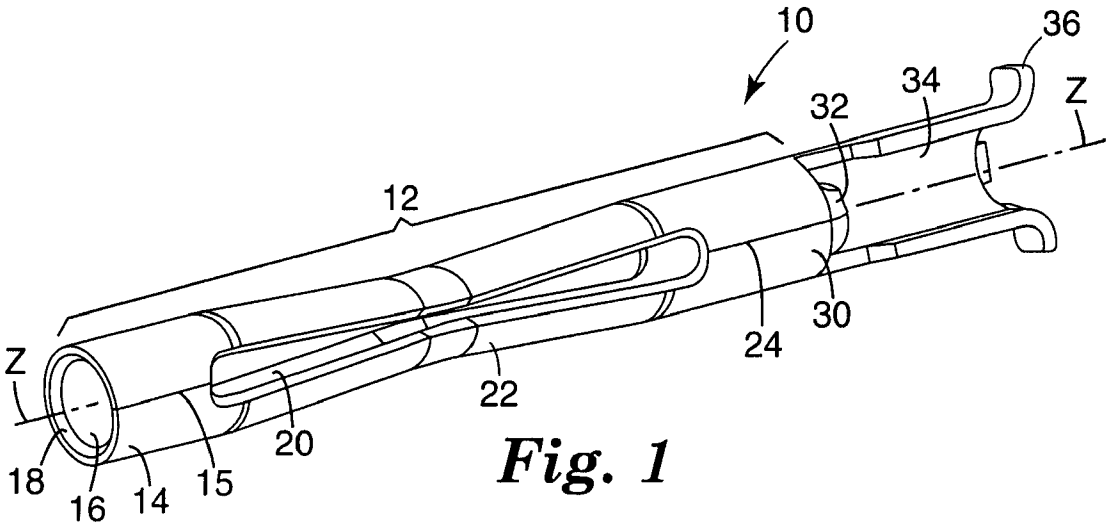
FIG. 1 is an isometric view of an illustrative embodiment of a female electrical contact.

FIG. 1 illustrates one embodiment of a female electrical contact 10 in accordance with the present invention. The electrical contact has a substantially tubular, hollow body 12 having a first end 14 and a second end 30. For reference purposes, the contact has a longitudinal axis, shown as "z" in FIG. 1. As used herein, the phrase "substantially tubular" means that the hollow body itself is generally cylindrical in structure but that the diameter of cylinder, when the contact is not mated with a signal pin, varies along the longitudinal axis of the connector. In a preferred embodiment, when the electrical contact is not mated, from the first end 14, the diameter of the hollow body gradually decreases to a minimum diameter at the midsection of the hollow body and then enlarges as it approaches the second end 30. The first end has a bounded aperture 16 to receive a signal pin (not shown). Preferably, the first end has been processed to provide for a lead-in chamfer 18 to aid in the mating of the signal pins. The term "bounded" as used herein means that the ring (generally shown as 18) forms the boundary of the aperture. Bounded does not imply that the aperture has to be defined by a continuous opening, and in fact, FIG. 1 shows that there is a seam 15. The hollow body contains at least two contact members 22 lying between two elongated slots 20. The contact members and the elongated slots lie generally parallel to the longitudinal axis.

Figure 4:
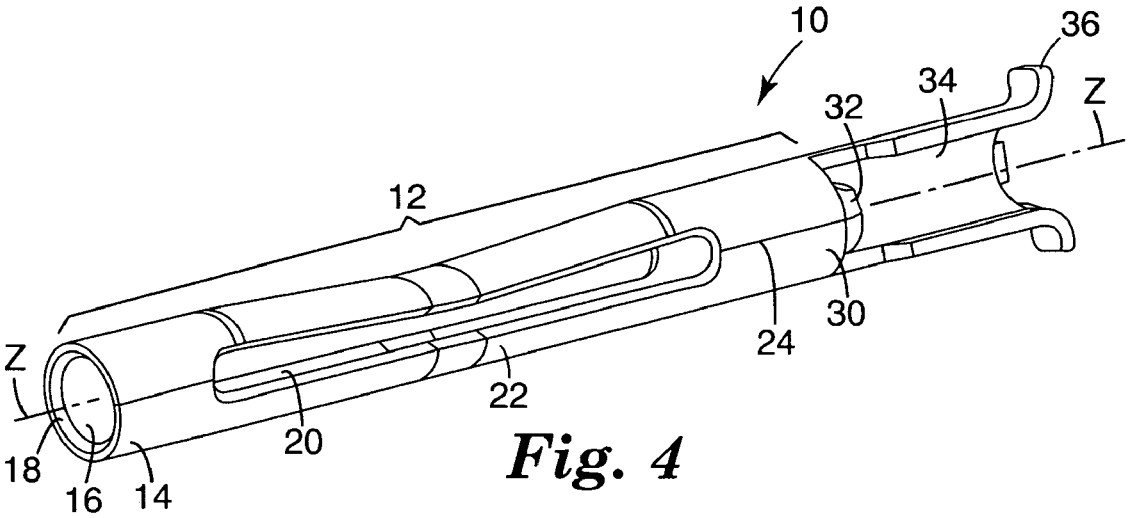
FIG. 4 is an isometric view of another illustrative embodiment of a female electrical contact.
Figure 7:
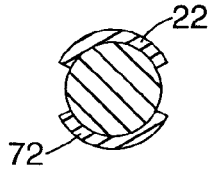
FIG. 7 is a cross-sectional view taken along line 7-7 of FIG. 6.

FIG. 1 shows that both contact members 22 have compound curves while FIG. 4 shows that at least one of the contact members (the top one) has a compound curve. As used herein, the term "compound curve" means that the contact member has curvature in two directions. The compound curves are present when the electrical contact does not contain a mating signal pin. In a preferred embodiment, along the length of the hollow body the contact members 22 are rounded inwardly, i.e., concave towards the z-axis. And, the outer surface of the contact members is convex, i.e., curved like the exterior surface of the sphere. As shown in FIG. 7, this compound curve nature allows for intimate contact between the signal pin (typically circular in cross-section) and the contact members thereby improving electrical connection between them. The present invention differs from that of U.S. Pat. No. 5,190,472 where its contact 3 is rectangular in cross-section and thus has localized contact to its signal pin 55 as shown in its FIG. 7.

One of the advantages of the present invention is that, due to its elongated tubular design, the contact has a large area (defined generally by the surface area around the contact members) where mating with the signal pin can occur. With repeated mating of the signal pin to the contact, the mating surfaces on the pin and on the contact will likely wear down thereby possibly degrading the electrical connection therebetween. By increasing the surface area for contact, there is an increased likelihood of making a good electrical contact between the pin and the contact members over an extended period of time. In contrast, U.S. Pat. No. 4,359,258 shows a rather localized area, defined by designated contact area 35 (in its FIG. 2), where mating of the pins and its socket 16 occurs.

In one embodiment, at the second end 30 of the hollow body, there is a wire stop 32. The wire stop functions primarily to act as a stop for the central conductor of a transmission line cable, as further explained in FIG. 2. Also, the wire stop can minimize the wicking of solder when the central conductor of a coaxial cable is assembled to the electrical contact. Adjacent to the second end of the hollow body is a solder cup 34. The solder cup has a means for bearing against the insulator of a transmission cable line to stop the electrical contact from penetrating into the cable line during assembly or during mating with the signal pin. One useful means is a flared portion located distal to the second end of the electrical connector. In one embodiment, the flared portion is a positioning arm, shown as 36 in FIG. 2. In a preferred embodiment, the solder cup has three positioning arms.

Figure 2:
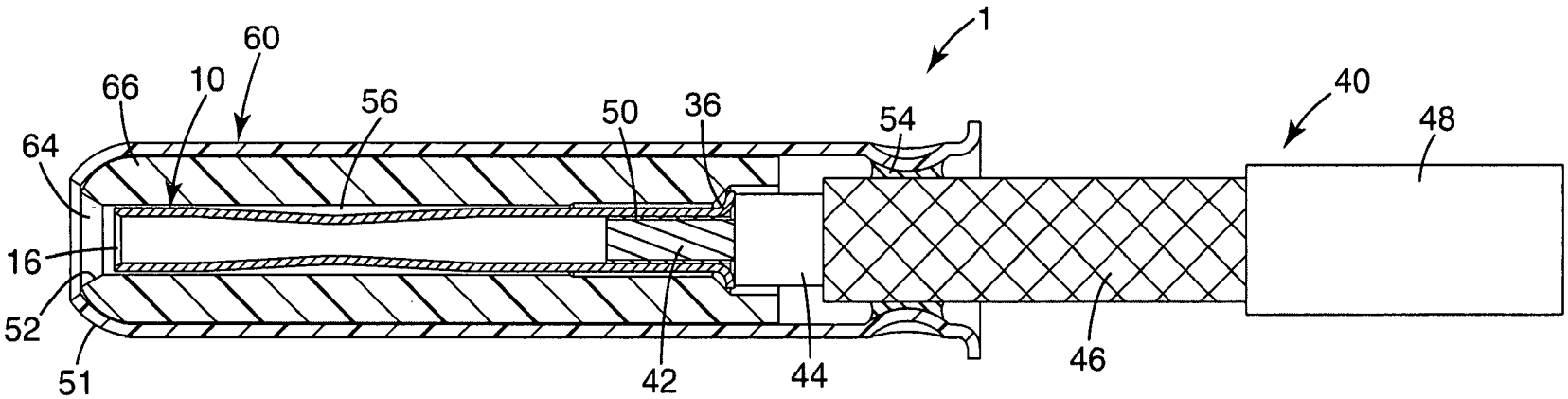
FIG. 2 is a cross-sectional view of an illustrative terminated electrical connector.
Figure 8:
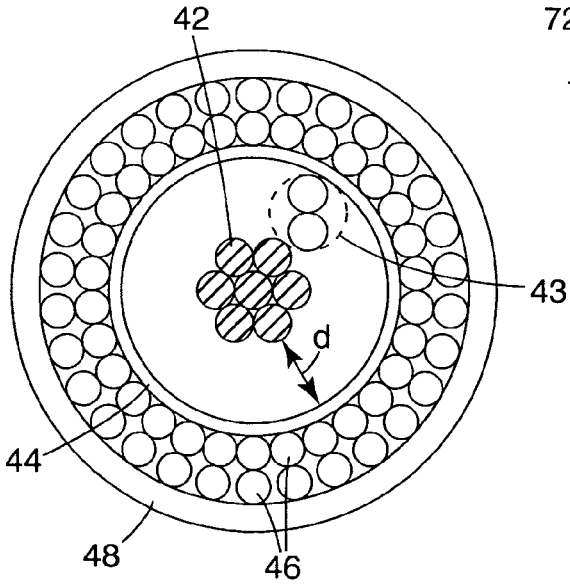
FIG. 8 is a cross-sectional view of an illustrative micro-axial cable.

FIG. 2 illustrates one embodiment of a terminated electrical connector 1. A micro coaxial cable 40 is mated with the electrical contact 10. A conductive shell 60 covers the entire electrical connector and a portion of the micro coaxial cable. The micro coaxial cable typically has a central signal conductor 42, optionally insulative filaments wrapped around the central conductor (not shown), a core tube 44 surrounding the central signal conductor and the filaments (if used), at least one layer of braid 46, typically metal, shielding the core tube, and a jacket 48 surrounding the layer of metal wire. The positioning arms 36 on the electrical connector abut the core tube 44 on the micro coaxial cable. And, the central signal conductor 42 resides in the solder cup up to the wire stop 32. FIG. 8 shows a cross-sectional view of a micro coaxial cable with filament 43 and two layers of braid 46. The positioning arm 36 would span the distance "d" between the central conductor 42 and the core tube 44. Distance "d" may comprise an air gap, as shown in FIG. 8.

The central conductor can be anchored to the solder cup through the use of a soldering medium 50. The conductive shell 60 can be anchored to the cable 40 through the use of a solder medium 54 preferably at the braid 46. The conductive shell 60 has an opening 64 and an insulator 66. The opening 64, which has a lead-in 52, is aligned with the aperture 16 in the first end of the electrical contact, thus allowing for insertion of a signal pin (not shown). The conductive shell 60 is typically fabricated from a metal or metal alloy, such as brass and preferably has a lead-in curve 51 for ease in mating with other parts, such as a coupler. Because FIG. 2 shows a terminated electrical connector without the mating signal pin, the contact member is in relaxed state as shown by air gap 56.

Figure 5:
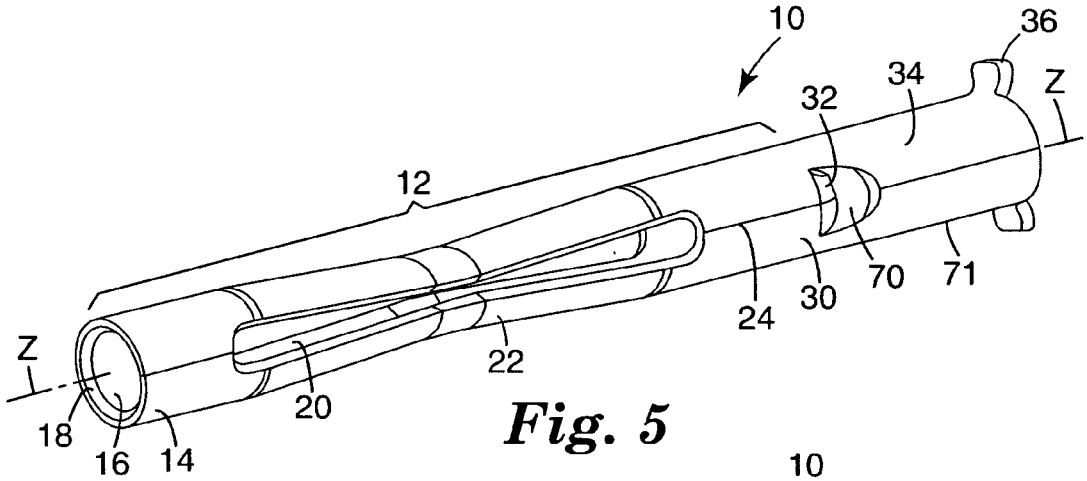
FIG. 5 is an isometric view of another illustrative embodiment of a female electrical contact.

FIG. 5 illustrates another embodiment of a female electrical contact 10 having an enclosed solder cup portion 71. Preferably a vent 70 is provided to allow solder flux vapor to vent when the central signal conductor is soldered to the solder cup. Because the enclosed solder cup portion has a constant diameter, this embodiment may have less impedance discontinuity when compared to the electrical contact of FIG. 1.

Figure 6:
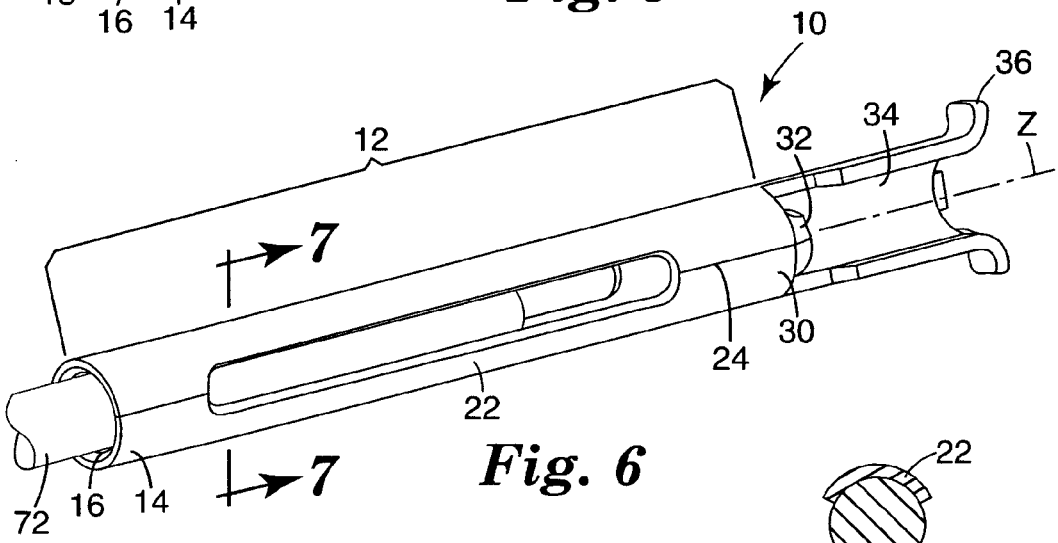
FIG. 6 is an isometric view of the embodiment of FIG. 1 with a signal pin inserted.

FIG. 6 shows the electrical contact 10 in use, i.e., when a signal pin 72 is inserted therein and at least a portion of the pin touches the contact members deflecting them outwards. The diameter of the signal pin determines the amount of deflection the contact members experience. As the contact members deflect, the tubular hollow body 12 changes in diameter, to accommodate the signal pin, and approaches the nominal diameter of the electrical contact. This change in diameter effectively provides for a socket with a constant diameter, thereby minimizing electrical discontinuities that inherently arise in a contact that has changes in geometry between the contact outside diameter and the conductive shell inside diameter. This constant diameter feature provides one key advantage of the present invention.

FIG. 7 is a cross-sectional view taken along line 7-7 in FIG. 6 and shows that the contact members 22 have intimate contact with signal pin 72 such that the contact members cup the signal pin. This type of intimate contact is in contrast to the type of contact disclosed in U.S. Pat. No. 5,190,472.

The inventive electrical connector can be used to mate or connect electrical conductors. Although FIGS. 2 and 8 show the use of the inventive electrical connector with a micro axial cable, the connector can be used with any kind of cable, whether coaxial or not. One skilled in the electrical connector art will recognize the variety of uses for the inventive electrical connector. For example, the terminated electrical connector can be loaded into a carrier and mated with a male coaxial connector, e.g., a coupler.

The electrical contacts are fabricated from metal substrates. As used herein, the term metal encompass pure metals and their alloys. Suitable metal substrates include copper and beryllium-copper alloys. In preferred embodiments, the metal substrates are covered, typically via a plating process, with other metal layers such as nickel, chrome, or gold. In a more preferred embodiment, the solder cup further contains a coating of tin and lead.

The electrical contacts can be of made of any suitable dimensions to mate several electrical conductors. In a preferred embodiment, the electrical contacts are used in conjunction with micro coaxial cables. In such a case, the electrical contact is typically about 0.1 to 0.5 inch (2.5 to 12.7 mm) in length. The opening in the first end of the hollow body has an outer diameter of about 0.1 to 0.4 inch (2.5 to 10.2 mm). The metal substrate is about 0.001 to 0.010 inch (0.025 to 0.25 mm) thick.

The inventors have discovered that the compound curve nature of the contact members yields a socket that is compatible with a wide range of signal pin diameters. This result is advantageous for the user because it relaxes the tolerance required for the signal pin. In general, the tighter the tolerance for a part, the more expensive it is to make it, particularly when the method of making the part involves some type of machining. It is believed that wider operating range for the pin diameter results from the ability of the contact members to deflect toward a zero force point between two undeflected, stable positions. For purposes of analogy only, the contact members act much like a bistable spring described in U.S. Pat. No. 4,703,301 (Hollweck et al.).

One advantage of the present invention is that the electrical contact can be manufactured using a stamping and forming process, which is more cost effective than a machining process. One illustrative stamping and forming process is described herein.

A strip of stock metal, such as copper, having a thickness of about 0.005 inch (0.13 mm), is supplied, usually in roll form, for a semi-continuous process. The stock metal is blanked using punches and dies through several processing stations. During the blanking process, typically a carrier is formed along the top and bottom of the stock metal. The carrier can have pilot holes so as to help guide the stock metal through the various processing stations. Also during the blanking process, typically, the shape of the electrical connector is stamped from the stock metal. At this point, the electrical contact is substantially flat. The electrical contact is conveyed along with the carrier, usually through some bars. After the electrical contact is stamped, various shaping dies are used to form it into its substantially tubular shape and the flared portions are also formed.

Figure 3:
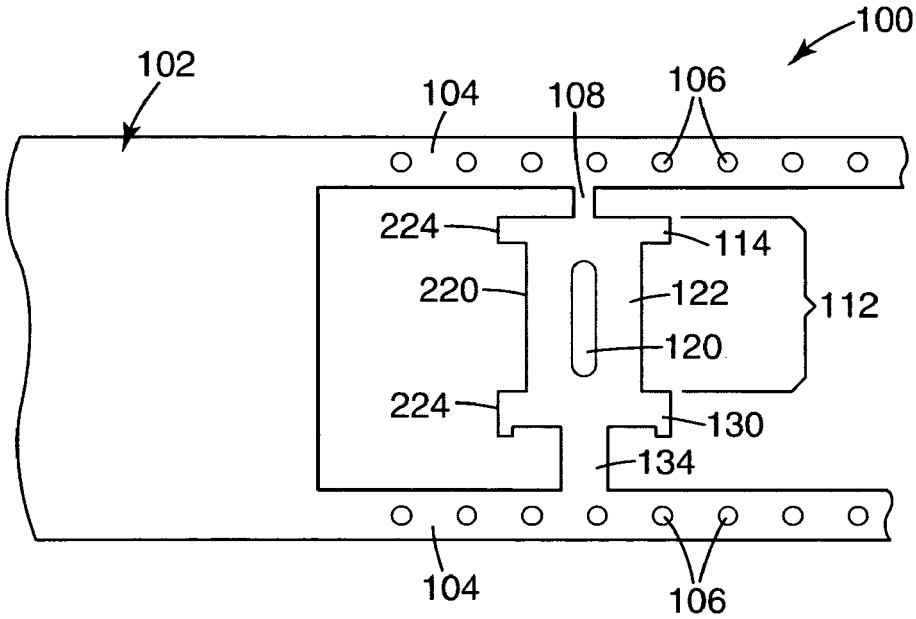
FIG. 3 is a schematic representation of a stamping step in the manufacturing of the electrical contact.

FIG. 3 schematically shows one illustrative step, in this case a stamping process, in the manufacturing process for one illustrative electrical contact. The in-process connector 100 has as a precursor stock metal 102 that have been partially blanked out to form carriers 104 and pilot holes 106. The electrical contact, at this processing stage appearing as a substantially flat and patterned metal sheet, is connected to the carrier through tie bar 108. The electrical contact has a body portion 112, a first winged portion 114, middle portion 122, elongated slot 120, second winged portion 130 and an extension 134 that will become the solder cup. At the forming step, the first and second winged portions and the middle portion are folded to form a tubular body having a first end, a second end generally as shown in FIG. 1. As a result of the forming step, two slots are formed; one corresponding to the slot 120 and the other is formed as a result of grooves 220 on both sides of the middle portion. Once folded, seams are formed when edges 224 meet. At other forming steps, the body portion is further processed to create compound curves on the contact members. While the foregoing general description on the stamping and forming method is useful to make the inventive electrical contact, one skilled in the art will recognize that variations to this description can be used to make the electrical contact.

All references cited herein, including those in the Background section are incorporated by reference, in each reference's entirety.

What is claimed is:

1. An electrical connector for use with a coaxial cable having a central signal conductor and an insulative core tube surrounding the central signal conductor such that an air gap is provided between the central conductor and the core tube, the electrical connector comprising:

a substantially tubular hollow body having a first end and a second end; and a solder cup disposed adjacent to said second end of said hollow body, said solder cup having a flared portion distal to said second end of said hollow body, wherein the flared portion is configured to span the air gap between the central conductor and the core tube to prevent the connector from entering into the air gap.

2. The electrical connector of claim 1, wherein the flared portion is configured to abut against the core tube of the coaxial cable and wherein the solder cup is configured to receive at least a portion of the central conductor of the coaxial cable.

3. The electrical connector of claim 1, wherein the flared portion of the solder cup comprises at least one radially extending positioning arm.

4. The electrical connector of claim 1, wherein the flared portion of the solder cup extends around a majority of a circumference of the solder cup.

5. An electrical connector for use with a coaxial cable having a central signal conductor and an insulative core tube surrounding the central signal conductor such that an air gap is provided between the central conductor and the core tube, the electrical connector comprising:

a substantially tubular hollow body having a first end and a second end; and the second end comprising a flared portion, wherein the flared portion is configured to span the air gap between the central conductor and the core tube to prevent the connector from entering into the air gap.

6. The electrical connector of claim 1, wherein the flared portion is configured to abut against the core tube of the coaxial cable.

7. The electrical connector of claim 1, wherein the flared portion comprises at least one radially extending positioning arm.

8. The electrical connector of claim 1, wherein the flared portion extends around a majority of a circumference of the hollow body.

* * * * *